US005114370A

United States Patent [19]

Moran

[11] Patent Number: 5,114,370

[45] Date of Patent: May 19, 1992

[54] BODYBOARD WITH VARIABLE STIFFNESS

[75] Inventor: Steven M. Moran, Long Beach, Calif.

[73] Assignee: Kransco, San Francisco, Calif.

[21] Appl. No.: 638,835

[22] Filed: Jan. 4, 1991

[51] Int. Cl.[5] ..... B63B 35/72;

[52] U.S. Cl. ..... 441/65; 441/74

[58] Field of Search ..... 441/65, 68, 74, 79; 114/357, 392; D21/228; 280/610; 428/71, 73

[56] References Cited

U.S. PATENT DOCUMENTS 3,414,919 12/1968 Gust ..... 441/74

FOREIGN PATENT DOCUMENTS 3019535 11/1981 Fed. Rep. of Germany ..... 441/74

3839805 5/1990 Fed. Rep. of Germany ..... 441/74

*Primary Examiner*—Edwin L. Swinehart

*Attorney, Agent, or Firm*—Kolisch, Hartwell, Dickinson, McCormack & Heuser

[57] ABSTRACT

A bodyboard is provided which incorporates selected regions of differing stiffness in order to combine in one board the speed associated with relatively stiff bodyboards and the maneuverability of soft bodyboards. Laminated into the layered structure of the bodyboard is a fiber mesh which has a size and orientation designed to stiffen the rear four-fifths of the bodyboard. The remainder of the board, adjacent the nose, incorporates a pattern of parallel arcuate channels which increase the bendability of the nose portion of the board. Because the board is stiff in the region supporting most of the weight of the rider, it has less drag than soft bodyboards and is fast. The flexibility in the nose area enhances maneuverability. The design of the reinforcing mesh and the bendability-enhancing nose inhibits the formation of permanent creases and allows the board to retain the overall appearance and internal laminated structure of prior art bodyboards.

5 Claims, 3 Drawing Sheets

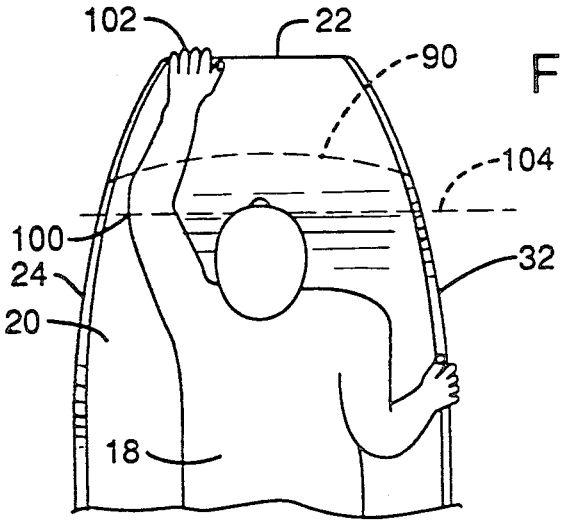
FIG. 7
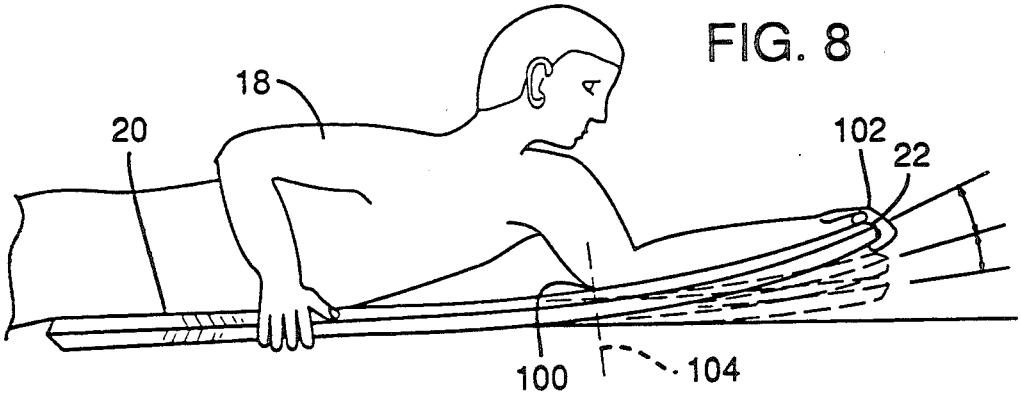
FIG. 8
FIG. 9
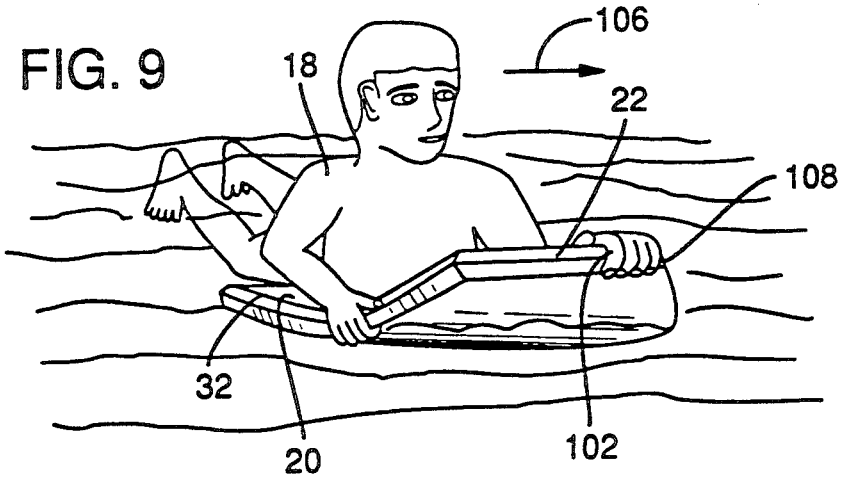

BODYBOARD WITH VARIABLE STIFFNESS

BACKGROUND AND SUMMARY OF THE INVENTION

The invention relates generally to sporting goods and recreational products, and more particularly to an improved bodyboard for use in riding ocean surf.

Bodyboards are devices used for riding the waves on the seashore, somewhat akin to surfboards. In form, bodyboards are a contoured, elongated foam plank covered with an outer skin which, on the bottom of the board, is generally slick and somewhat stiff for enhancing planing on the surf.

Bodyboards are ridden in a prone or procumbent position, with one arm extending forwardly for gripping the nose and the other arm positioned in a trailing manner for gripping the side edge of the board. With the arms and hands thus positioned, the rider can push or pull against the engaged front or side edges to control the attitude of the board in the surf for steering or maneuvering. The rider's legs, which trail the board, also help in maneuvering.

The stiffness or rigidity of a bodyboard can affect its riding and control characteristics. For example, a highly rigid or stiff board tends to have greater speed than a board which is soft or easily bendable. A stiff boards maintains its shape, has less drag and is more suited to use in a lighter surf with small waves where increased speed is more important than control. A soft, flexible board is more controllable than a stiff board because its shape can be twisted and turned to increase friction and drag on selected parts of the board, which assists in steering and maneuvering. Soft boards tend to be used in stronger surf where control is more important than speed.

It would be advantageous for a bodyboard to include the speed characteristics of a stiff board and the controllability of a soft board. In particular, a bodyboard with such a mixture of characteristics would be desirable in moderate-surf regions where speed could be enhanced without sacrificing control. The present invention provides both excellent planing characteristics and control by providing for regions of different stiffness over the length of the board. In particular the invention provides a variable flexure bodyboard in which one portion of the length of the board, constituting approximately the rear two-thirds to four-fifths of the board, is stiff relative to the nose of the board. The variation in the flexure characteristics of the board is provided by a combination of reinforcing stiffening devices in the stiff portion of the board and bendability-enhancing channels in the unstiffened nose portion of the board.

It is an object of the present invention to provide a bodyboard having different flexure and stiffness characteristics over selected predetermined regions of the board.

It is another object of the invention to provide a bodyboard in which the forward portion of the board, adjacent the nose, has enhanced flexibility and bendability yet is resistant to the formation of permanent creases or bends.

It is another object of the invention to provide a bodyboard which has the maneuverability of a relatively soft bodyboard and the speed of a relatively stiff bodyboard, due to selective stiffening of portions of the board.

Accordingly, the invention provides a bodyboard comprising an elongate, semi-rigid board structure which extends between a front nose end and rear tail end. The board structure has relatively less stiffness in a front portion of the board, adjacent the front end, and relatively greater stiffness in a second portion of the board extending generally rearwardly from the front portion. As a consequence, the front portion of the board has greater flexibility and bendability relative to the second portion of the board.

In its preferred form, the board structure includes a bottom skin which provides a planing surface and a top skin which provides a riding surface. Semi-rigid foam forms the major structural element between the top and bottom skins. Means are provided for stiffening a major portion of the length of the board from a region adjacent the tail to a region forward of the midpoint of the board, midway between the nose and tail ends. The stiffened portion, also referred to as the second portion of the board, incorporates the means for stiffening within the layered structure of the board. The stiffening means inhibits flexure and bending of the portion of the board in which it is installed. A forward bendable portion of the board, extending approximately from the nose end to the front edge of the stiffened portion, is unstiffened and relatively more flexible than the stiffened portion of the board. The unstiffened forward portion of the board facilitates bending and flexure of the region adjacent the nose.

In its preferred form, the means for stiffening is employed to stiffen approximately the rear two-thirds to four-fifths of the board by means of fiber mesh selectively embedded between the top skin and the semi-rigid foam core and between the bottom skin and the semi-rigid foam core. The bendability of the forward portion of the board is preferably enhanced by means of a plurality of parallel channels formed in the foam beneath the top skin of the board. The channels are arcuate and extend laterally across the board, arching toward the nose of the board. Such channels increase the bendability of the portion of the board in which they are formed while inhibiting permanent creasing of the board during use.

BRIEF DESCRIPTION OF THE DRAWINGS

FIG. 7 is a partial top plan view of a rider on the bodyboard, illustrating how the nose and side are gripped by the rider.

FIG. 8 is a side elevation of the board and rider of FIG. 7 illustrating adjustment of the forward rocker by the rider.

FIG. 9 is a perspective view of the front of the rider and board shown in FIGS. 7 and 8 illustrating how the nose is selectively bent to assist in steering and maneuvering.

DETAILED DESCRIPTION OF THE PREFERRED EMBODIMENT

Figure 1:
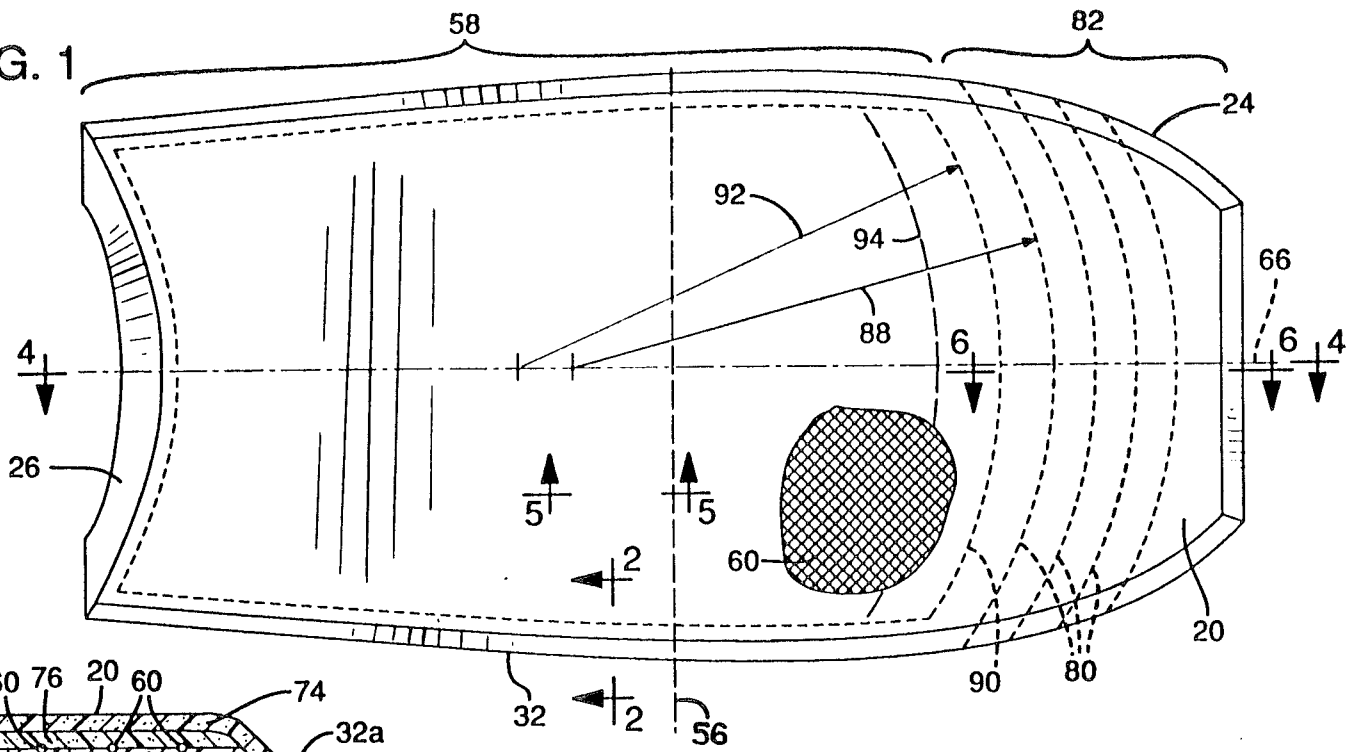
FIG. 1 is a top plan view of the bodyboard of FIG. 2, partially cut away, illustrating in phantom the relative positions of the reinforcing mesh and the bendability-enhancing channels.

FIG. 8 shows a bodyboarder 18, also referred to as a bodyboard rider 18, riding a bodyboard 20 in a typical riding position. One arm is extended forwardly gripping the nose end 22 of bodyboard 20 while the other arm is disposed in a trailing manner for engaging side rail 32. Rider 18 is on his stomach, in a prone or procumbent position, and is propped up on the elbow of the forward arm with his chest and torso resting on the board and his waste at or near the tail end 26 of the board. In this position, the rider steers or maneuvers the board by leaning, use of his legs, and manipulating the board. The structure of board 20 includes a relatively flexible, bendable nose portion adjacent nose end 22, with the remainder of the board relatively stiff. The construction of board 20 provides for the variable or differential flexibility in accordance with the present invention, enhancing the performance of the board.

Referring to FIG. 1, bodyboard 20 is an elongate, substantially planar board having a top surface or skin 28, a bottom surface or skin 30, a nose or forward end 22, a tail or back end 26 and left and right side longitudinal, laterally-opposed edges 24, 32, respectively. The side edges are beveled and include, on the left side, a top beveled surface 24*a*, called a chive, and a bottom beveled surface 24*b*, which supports the side rail of the board. Equivalent top and bottom beveled surfaces 32*a*, 32*b* are provided on right side edge 30 (see FIG. 2).

The internal and external construction of the board will be described with reference to FIGS. 1, 2, 3, 4, 5, and 6. At the center of the board, forming the majority of the volume of the board, is a core 40 of semi-rigid foam called Ethafoam®, a synthetic foam product marketed by Dow Chemical Co. Foam core 40 is relatively stiff and dense and, although resiliently deformable, will tend to retain its shape and define the overall shape of the bodyboard. In a typical board of approximately 4-feet in length, foam core 40 will be 2-inches to 3-inches in thickness at the midportion of the board and will taper downwardly to a smaller thickness adjacent nose end 22. The longitudinal sides 44, 46 of the core taper toward one another adjacent nose end 22. A forward-arching concave indentation is formed in tail end 26. The underside of core 40 curves upwardly from the midpoint of the board toward the nose and tail ends and define nose and tail rockers, or upwardly curving planing surfaces. The longitudinal sides 44, 46 and nose and tail ends of the foam core are beveled to accommodate the beveled side edges of the bodyboard (see FIGS. 1, 4, and 6).

Overlying foam core 40 is an intermediate structure, which includes the stiffening means of the present invention, and a top skin 28 preferably formed of a high-density foam such as Ethafoam®. Top skin 28 covers both the entire top surface of the bodyboard and the upper chive portions 24*a*, 32*a* of the side edges (see FIGS. 2 and 6). Bonded to the underside of foam core 40 is an intermediate stiffening layer, in accordance with the present invention, and a bottom skin 30. The bottom skin is formed of polyvinyl chloride (PVC), generally one-sixteenth inch or less in thickness, and provides a hard, shiny surface which is resiliently flexible. Longitudinal side rails, 24*b*, 32*b*, formed of expanded foam such as Ethafoam®, are bonded by thermolamination or another suitable technique to the underbeveled side edges 44, 46 of foam core 40 (see FIG. 2) and are part of the side edges 24, 32 of the bodyboard. A laminated tail piece 54 is bonded to tail end 26.

One important feature of the present invention is the provision of stiffening means for increasing the stiffness of a major portion of the board between a region adjacent tail end 26 and a region forward of the midpoint 56 of the board. Midpoint 56 is located longitudinally midway between the front (nose) end 22 and rear (tail) end 26. The stiffened portion of the board, also referred to as the second portion, is the rear approximately two-thirds to four-fifths of the board, indicated in FIG. 1 at 58. The preferred means for stiffening portion 58 of the board is the inclusion of one or more layers of stiffening material between the outer skin of the board and the foam core 40. The stiffening layers are laminated into the board structure intermediately between the foam core and the top skin and between the foam core and the bottom skin. In the preferred embodiment, these stiffening layers are relatively thin sheets of thermoplastic fiber mesh. Referred to alternatively as stiffening means, stiffening layers or stiffeners, the fiber mesh layers are laminated into the board structure in selected regions of the board to define the stiffened portion 58 of the board.

Figure 3:
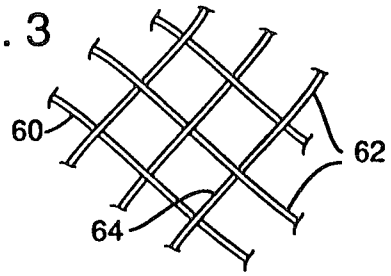
FIG. 3 is a perspective view, on an enlarged scale, of a portion of the fiber mesh reinforcing or stiffening layer employed in the preferred embodiment and shown schematically in FIG. 1.

Upper stiffening fiber mesh layer 60, shown schematically in FIG. 1, is an open cross weave pattern of thermoplastic filaments formed of polyethylene, polypropylene or a blend of those two thermoplastics. A portion of the fiber mesh is shown in FIG. 3. Each strand 62 of the fiber mesh is in the range of approximately 0.02-inch to 0.1-inch in diameter, with the preferred diameter being approximately 0.043-inch. The cross-hatched pattern of fiber filaments have about three-eighths-inch to 1.25-inch spacing between the individual fibers. The fibers shown in FIG. 3 are locked together at the intersection points during fabrication of the mesh by thermomelting or a similar process. The mesh has an overall ratio of fiber thickness to mesh opening area 64 (which is the area between and enclosed by adjacent strands) in the range of between about 1-to-8 and 1-to-15. The preferred strand diameter/opening area ratio is approximately 1-to-10. As shown in FIG. 1, the upper fiber mesh layer 60 extends over the generally flat top surface of the foam core and adjacent, but not over the beveled longitudinal sides 24, 30 and beveled tail 26. The orientation of the individual fiber strands in mesh 60 is diagonal relative to the longitudinal center line 66 of board 20. Diagonal orientation allows for some flexure of the mesh in the longitudinal direction, parallel to center line 66, while inhibiting the formation of lateral creases in the board.

Figure 4:
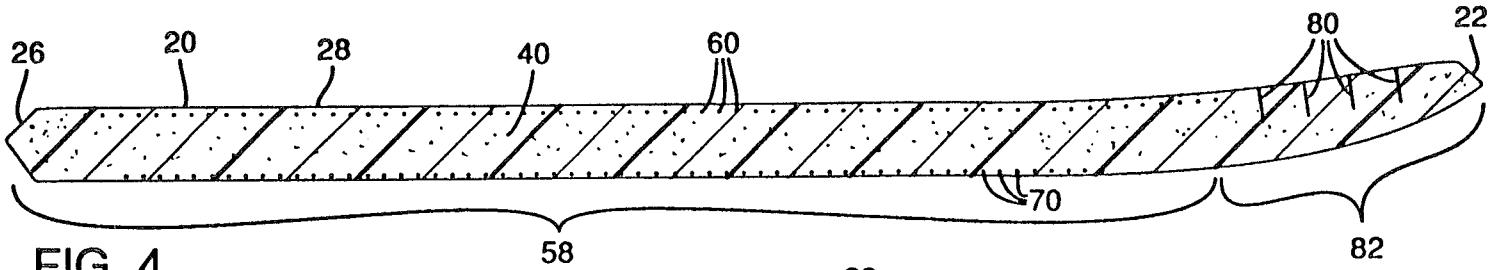
FIG. 4 is a side, cross-sectional, longitudinal view of the bodyboard taken along line 4—4 of FIG. 1.

In addition to the upper fiber mesh layer 60, the means for stiffening region 58 of the board includes a lower fiber mesh layer 70, laminated between foam core 40 and bottom skin 30. The fiber strand size, strand size-to-mesh opening ratio and mesh orientation are the same for lower mesh layer 70 as for upper mesh layer 60. The overall longitudinal length of lower mesh 70 is generally shorter than upper mesh 60. As shown in FIG. 4, lower mesh 70 extends slightly less far toward the nose and tail of the board, compared with upper mesh 60. Stiffened portion 58 extends generally rearwardly from the front end (unstiffened) portion of the board.

Figure 5:
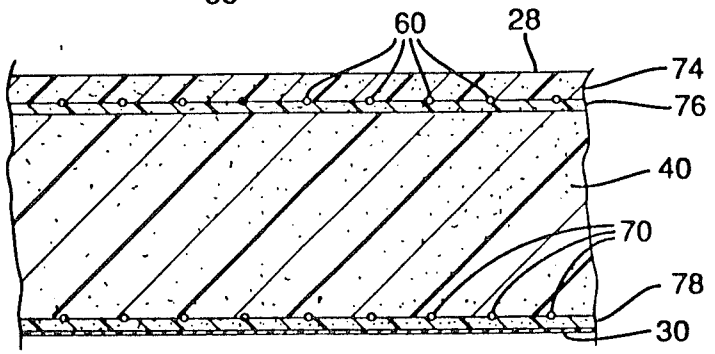
FIG. 5 is an enlarged cross-sectional view of a portion of the view shown in FIG. 4, taken between lines 5—5 of FIG. 1.

FIG. 5 shows the layered construction of bodyboard 20 in greatest detail. Upper reinforcing mesh 60 and lower reinforcing mesh 70 are laminated into the layered structure of board 20 between the foam core 40 and outer skin surfaces. Top skin 20, which is a thin sheet of Ethafoam ® or another suitable foam material, has a thickness generally between one-eighth-inch and one-quarter-inch. Referring to FIG. 5, top skin 28 is illustrated in cross-section as a foam layer 74. Another foam layer 76 is placed intermediate between upper foam layer 74 and core 40. Upper reinforcing mesh layer 60 is thermolaminated between the top skin foam layer 74 and adjacent intermediate layer 76, which is thermolaminated to foam core 40.

By sandwiching upper mesh 60 between two layers of Ethafoam ® 74, 76, the depth of the mesh layer beneath top skin 28 can be selected to control the depth of the mesh within the board structure. It might be desirable, for example, to locate upper mesh layer 60 close to the surface of top skin 28 so the mesh will form a noticeable pattern of ridges on the top of the board. That is accomplished by making layer 74 relatively thin. To bury mesh layer 60 further beneath top surface 28, top skin layer 74 is made relatively thick. Intermediate layer 76 is optional and could be eliminated, positioning mesh 60 directly between top skin layer 74 and foam core 40.

Installation of reinforcing mesh 60 during fabrication of the board does not greatly alter the manufacturing steps for fabricating the layered board structure. Adjacent layers of Ethafoam ® are thermolaminated together during manufacture of a board and that thermolamination is also effective through the openings 64 in the fiber mesh. Consequently, during the bonding together of adjacent foam layers, the mesh is simply sandwiched between the adjacent layers of the Ethafoam ® and the fibers become embedded in the foam. Thus, except for proper positioning of the fiber mesh as the layers are bonded, conventional thermolamination techniques for assembling the laminated board structure can be employed in constructing the board.

The lower fiber mesh layer 70 is installed in the board structure in the same way as upper mesh layer 60. Bottom skin 30 consists generally of a dense, shiny sheet of PVC backed by a thin (i.e., less than one-quarter-inch thick) layer 78 of Ethafoam ®. Lower reinforcing mesh 70 is positioned between the Ethafoam ® backing layer 78 and the foam core 40 and is secured between the adjacent foam layers by thermolamination.

Figure 2:
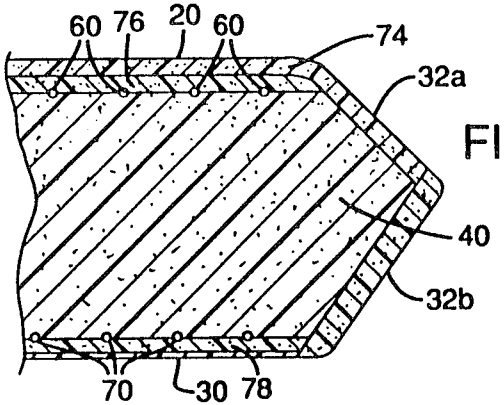
FIG. 2 is a side cross-sectional view on an enlarged scale taken along line 2—2 of FIG. 1.

FIG. 2 shows an enlarged cross-sectional view of the right longitudinal side edge 32 of board 20 and illustrates the side extent of upper and lower mesh layers 60, 70, respectively. It also shows the location of side rail 32*b* relative to the side beveled edge 46 of foam core 40. Upper beveled edge 32*a*, termed the chive, is covered by side portions of top skin 20.

Figure 6:
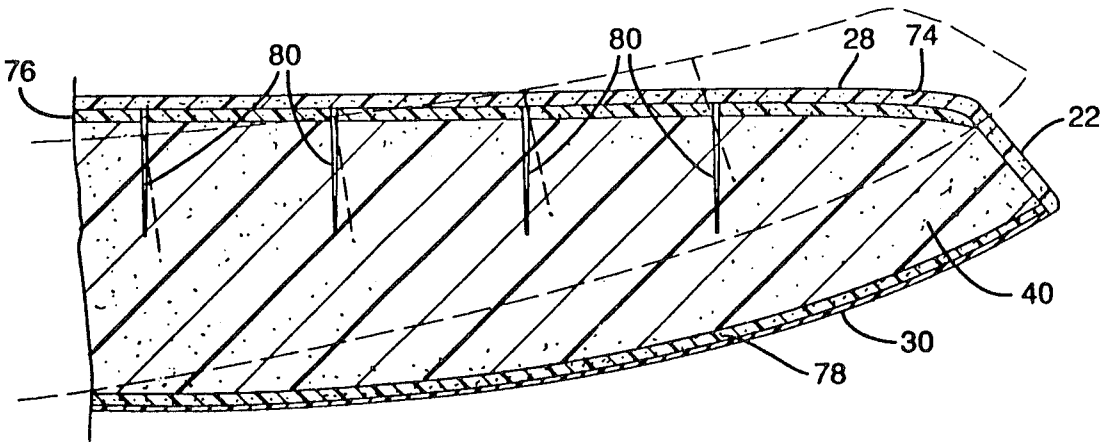
FIG. 6 is an enlarged, side cross-sectional view showing a portion of the nose of the bodyboard, taken along line 6—6 of FIG. 1.

FIG. 6 shows a portion of the nose of board 20 in cross-section and illustrates the use of a preferred means for increasing the bendability of the forward portion of the board. One or more longitudinally-extending channels 80 extend into the foam core of the board beneath top skin 20. Each channel extends laterally across the board in a region of the board termed the forward or nose portion 82 (see FIGS. 1 and 4). Referring to FIGS. 1 and 6, each channel 80 extends between the elongate, laterally-opposed side edges 24, 32 of the board. Channels 80 extend from below the topmost laminated layer 74 (FIG. 5) through intermediate layer 76 and into foam core 40. Each channel includes a region of removed foam core material extending downwardly to a depth of approximately three-eighths to seven-eighths the thickness of core 40. For example, if core 40 is 2-inches thick in forward portion 82, and intermediate layer 76 is one-eighth-inch thick, each channel 80 would preferably be approximately one-inch deep. The spacing 86 between each adjacent channel is preferably approximately equal to the depth of each channel or, in the above example, approximately 1-inch. The channels thus have a depth and spacing which is in the range of about three-eighths to seven-eighths the thickness of the core of the bodyboard.

From FIG. 1 it can be seen that channels 80 are arcuate, arching toward the nose of the board. A radial arch centered along central axis 66, such as radius line 88 in FIG. 1, is appropriate for channels 80. The spacing and arcuate shape of channels 80 minimizes regions of stress concentration, thereby inhibiting the tendency of the forward portion 82 of board 20 to crease as nose 22 is bent upwardly. The forward end 90 of upper reinforcing mesh 60 is also preferably arcuate and arches toward the nose 22 of board 20 around a radius 92, which is approximately equal to radius 88. Similarly, the forward edge 94 of lower reinforcing mesh layer 70 is preferably arcuate and arches toward the nose 22 of board 20. As noted above, the arcuate pattern of channels 80, together with the arcuate forward ends of the reinforcing fiber mesh layers, tends to inhibit creasing of the board as the nose of the board is bent upwardly.

The width of each channel 80 is preferably less than approximately one-quarter-inch. In the preferred embodiment, as shown in FIG. 6, each channel 80 is widest adjacent its opening beneath top skin 28. The facing walls of the channel taper downwardly toward one another in an elongated, narrow "V" to the bottom of the channel. Formation of channels 80 is preferably accomplished during fabrication of the bodyboard by scoring or cutting away material from the top surface of foam core 40, after intermediate layer 76 has been applied to the top of the foam core. Top skin 74 covers the channels, when applied over intermediate layer 76, so the channels do not extend through top skin 28. FIG. 6 illustrates, in phantom, how the walls of the channels squeeze together as the nose 22 of the board is bent upwardly in a direction transverse to the longitudinal axis 66 of the board. The result of forming channels 80 in the board structure is a pattern of scoring of the semi-rigid roam beneath the top skin 28 in forward portion 82 of the board.

The structure of board 20 causes portions of board 20 to have selected stiffness or bendability which can vary over the surface and length of the board. The major portion of board 20, in region 58, extending from adjacent tail 26 to a region forward of midpoint 54 of the board, is reinforced and stiffened to increase the stiffness of the board structure. The remainder of the board, in the region forward of stiffened portion 58, is unreinforced and has greater flexibility or bendability, relative to the stiffened portion. Front portion 82 encompasses between approximately fifteen percent and forty percent of the length of the board. The parallel or transverse channels 80 are used as a means of enhancing the bendability or flexibility of nose portion 82. Bodyboard 20 thus combines the structure of a stiff board in those rear portions of the board which are generally submerged and tend to support the rider, and the structure of a soft, flexible board in the nose region, which is generally out of the water and used for controlling and maneuvering the board.

FIGS. 7, 8 and 9 illustrate how a typical rider 18 makes use of the board and explains part of the rationale for the position of the reinforcing mesh. During normal use, rider 18 is in the position shown in FIG. 7, with one hand gripping the nose 22 and the other hand gripping the side rail. The rider will be resting some of his forward weight on the forward-extending arm, at the elbow 100. If the rider wishes to increase the curvature of the front of the board, to raise the nose rocker, his forward hand 102, gripping the nose 22 of the board, pulls upward and backward in a levering action, with elbow 100 acting as a kind of fulcrum point. That action applies substantial pressure to the top of the board beneath the rider's elbow. For that reason, upper reinforcing mesh layer 60 preferably extends to a point forward of the elbow 100 of rider 18. Considering human anatomy, the 95th percentile distance between the back of a rider's elbow 100 and nose 22, when his hand is gripping the nose as shown, is approximately 18-inches. Accordingly, upper reinforcing mesh layer 60 is designed to extend forward of a line 104 (indicated in phantom in FIG. 7) approximately 18-inches rearward of nose 22. Preferably, mesh layer 60 extends forward of line 104 to approximately 8-to-12-inches from nose 22. That allows the forward part of the reinforcing mesh to reinforce the board at the point of maximum pressure exerted by the rider's elbow. The forward end of upper mesh 60 is indicated by line 90. The bendability-enhancing channels 80 are positioned between the forward end of mesh 90 and nose 22, in region 82. It has been found that lower wire mesh 70 need not extend as far forward as upper wire mesh 80, since the lower mesh is not as close to the elbow. The lower mesh can be extended forward to increase the region of stiffness or degree of stiffness, if desired.

To control the speed or maneuver the board, while riding the surf, rider 18 selectively adjusts the height of nose 22 in the manner shown in FIG. 8. By raising nose 22, the rider bends the forward portion of the board along an axis generally transverse to the longitudinal axis 66 of the board. Raising the nose relative to the rest of the board tends to increase drag and help prevent the nose from burying in the water. To effect a turn, the rider will grasp one corner of nose 22, as shown in FIG. 9, and lean in the direction of the turn, which in FIG. 9 is left. By raising the forward corner 108 slightly, rider 18 helps prevent the corner from burying itself into the water as the rider leans in direction 106. It also allows the rider to make small but important changes in the drag characteristics of the bodyboard, which helps in cornering as well as in other maneuvers such as 360-degree turns. To effect a right turn, rider 18 will usually switch hand positions from that shown in FIGS. 7, 8 and 9, moving the right arm forward to grasp the nose, with the left arm trailing, so the left hand can grip the left side rail.

The variable stiffness bodyboard of the present invention has the maneuverability advantages of a soft bodyboard and the speed of a stiff bodyboard. It maximizes maneuverability by providing a predetermined, bendable or flexible region in the portion of the board adjacent the nose, where manipulations of the bodyboard's shape and contours are effected. The result is a bodyboard which is very nearly, if not equally, as maneuverable as a relatively soft, flexible board, but which has substantially less drag. The invention allows the manufacturer to select the degree of stiffness in the stiff regions and the degree of bendability or flexibility in the bendable regions of the board. The size and shape of the stiffened portion or portions of the board can be readily and precisely controlled since the stiffened area conforms to the shape and position of the mesh in the laminated structure, which can be readily shaped prior to fabrication of the board. Similarly, a greater or lesser number of flexibility-enhancing channels can be applied in various regions of the board to meet the design and maneuverability goals of the board architect.

Alternative bodyboards incorporating the variable stiffness/bendability features of the variable flexure bodyboard are possible within the scope of the present invention. For example, bodyboards having different shapes, grip-enhancing surfaces, lengths or sizes could accommodate the selective flexure design of the present invention. Bodyboards requiring only a small increase in stiffness could employ only a single stiffening mesh layer or, to further enhance stiffness, three or more stiffening layers could be built into the structure. Alternative configurations of the stiffening means could be used. For example, laminated sheets or strips of hard, resilient material might be substituted as the stiffening device in place of or together with the open-weave mesh. Other means for increasing the bendability of the board, within the scope of the present invention, might include discontinuous channels, slots or openings extending into the foam core of the board. Such alternative bendability-enhancing structural features should preferably include designs which minimize regions of stress concentration to prevent permanent creasing, like the arcuate shape of the channels in the preferred embodiment. Yet another alternative construction within the scope of the present invention is to selectively stiffen regions of a relatively soft board, leaving the forward region adjacent the nose of the bodyboard unstiffened. Bendability enhancing features could be omitted. The result would still be a substantial difference in flexibility and bendability of the forward region adjacent the nose, relative to the remainder of the board. These and other alternative bodyboard constructions incorporating regions of increased and decreased flexibility or bendability along the length of the board are within the scope of the present invention.

The present invention provides a bodyboard having different flexure and stiffness characteristics over selected predetermined regions of the board. It additionally provides a bodyboard in which the forward portion of the board, adjacent the nose, has enhanced flexibility and bendability yet is resistant to the formation of permanent creases or bends. The invention also provides a bodyboard which has the maneuverability of a relatively soft bodyboard and the speed of a relatively stiff bodyboard, as a result of selected stiffening of portions of the board.

While the present invention has been shown and described with reference to the foregoing preferred embodiment, it will be apparent to those skilled in the art that other changes in form and detail may be made without departing from the scope and spirit of the invention as defined in the appended claims.

What is claimed is:

1. A bodyboard comprising:

an elongate board extending between a front nose end and rear tail end and including a bottom skin which provides a planing surface, a semi-rigid foam core, a top skin which provides a riding surface, and laterally-opposed side edges extending from the nose end to the tail end, the board including a stiffened portion encompassing a major portion of the length of the board from a region adjacent the tail end to a region forward of the midpoint between the nose end and tail ends, the stiffened portion extending generally between the side edges of the board, the board structure in the stiffened portion further including a lower stiffening layer including thermoplastic fiber mesh laminated between the foam core and the bottom skin and an upper stiffening layer including thermoplastic fiber mesh laminated between the foam core and the top skin, and a plurality of parallel, generally arcuate channels extending into the foam beneath the top skin in the portion of the board forward of the stiffened portion for enhancing the flexure and bendability of the forward portion of the board, the parallel channels extending laterally between the side edges of the board and arching toward the nose end of the board.

2. A bodyboard as in claim 1 in which the channels in the forward portion of the board have a depth and spacing which is in the range of about three-eighths to seven-eighths the thickness of the foam core, the thermoplastic fiber mesh used in the upper and lower stiffening layers has a ratio of fiber thickness-to-fiber spacing in the range of between about 1-to-8 and 1-to-15, and the orientation of the fibers in the fiber mesh is diagonal relative to the center longitudinal axis of the board.

3. A bodyboard as in claim 1 in which the foam core is approximately 2-inches thick in the portion of the board forward of the stiffened portion, each channel is less than one-quarter-inch in width, and the channels have a depth and spacing between adjacent channels in the range of between about 0.8-inch and 1.8-inches.

4. A bodyboard as in claim 1 in which the lower stiffening layer includes a thin boundary layer of semi-rigid foam between the bottom skin and the fiber mesh, the fiber mesh being bonded between the boundary layer and the core, and the upper stiffening layer includes at least one thin boundary layer of semi-rigid foam, the fiber mesh being bonded between the boundary layer and the core.

5. A bodyboard as in claim 1 in which the upper stiffening layer has a forward end closest to the nose end of the board, the forward end of the upper stiffening layer being arcuate and approximately parallel with the arcuate channels in the forward portion of the board.

* * * * *